US008079804B2

(12) United States Patent
Shteyman et al.

(10) Patent No.: US 8,079,804 B2
(45) Date of Patent: Dec. 20, 2011

(54) COOLING STRUCTURE FOR OUTER SURFACE OF A GAS TURBINE CASE

(75) Inventors: Yevgeniy Shteyman, West Palm Beach, FL (US); Frank Tsai, Orlando, FL (US); James F. Marshall, Port St. Lucie, FL (US); Scott W. Smith, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 662 days.

(21) Appl. No.: 12/212,840

(22) Filed: Sep. 18, 2008

(65) Prior Publication Data

US 2010/0068043 A1 Mar. 18, 2010

(51) Int. Cl.
*F01D 5/14* (2006.01)
*F03D 11/00* (2006.01)
*F04D 29/38* (2006.01)

(52) U.S. Cl. ..... 415/115; 415/177; 60/752; 60/768; 60/775; 60/806

(58) Field of Classification Search ..... 415/115, 415/116, 177, 176, 114, 175; 60/752, 775, 60/768, 806
See application file for complete search history.

(56) References Cited

U.S. PATENT DOCUMENTS

| | | | | |
|---|---|---|---|---|
| 2,257,982 | A | 10/1941 | Seippel | |
| 2,655,307 | A | 10/1953 | Buckland at al. | |
| 3,034,298 | A | 5/1962 | White | |
| 3,736,069 | A | 5/1973 | Beam, Jr. et al. | |
| 4,825,643 | A | 5/1989 | Hennecke et al. | |
| 5,628,182 | A * | 5/1997 | Mowill | 60/804 |
| 5,680,767 | A * | 10/1997 | Lee et al. | 60/760 |
| 5,758,503 | A | 6/1998 | DuBell et al. | |
| 5,865,030 | A | 2/1999 | Matsuhama | |
| 6,122,917 | A * | 9/2000 | Senior | 60/752 |
| 6,164,075 | A | 12/2000 | Igarashi et al. | |
| 6,173,561 | B1 | 1/2001 | Sato et al. | |
| 6,282,905 | B1 | 9/2001 | Sata et al. | |
| 6,295,803 | B1 * | 10/2001 | Bancalari | 60/39.511 |
| 6,322,320 | B1 | 11/2001 | Pfeiffer et al. | |
| 6,389,797 | B1 | 5/2002 | Sugishita et al. | |
| 6,647,730 | B2 | 11/2003 | Liu | |
| 7,040,097 | B2 * | 5/2006 | Mukherjee | 60/775 |
| 7,065,971 | B2 | 6/2006 | Bellucci et al. | |
| 2006/0073010 | A1 | 4/2006 | Busekros et al. | |
| 2006/0191274 | A1 | 8/2006 | Jurjevic | |

OTHER PUBLICATIONS

MJ Moore; Nox emission control in gas turbines for combined cycle gas turbine plant; Proceedings of the I Mech E Part A Journal of Power and Energy; Jan. 1997; pp. 43-52(10); vol. 211, No. 1; Professional Engineering Publishing.

R.C. Hendricks et al.; Modeling of a Sequential Two-Stage Combustor; NASA/TM-2005-212631; ISROMAC10-2004-037; Mar. 2005; pp. 1-17.

* cited by examiner

*Primary Examiner* — David Nhu

(57) ABSTRACT

A gas turbine case is provided including an outer case surface, and a channel portion formed as a recessed area extending radially inwardly into the outer case surface. The channel portion extends about a circumference of the case. An outer flow jacket is attached to the outer case surface and extends over the channel portion to define an enclosed cooling passage along the outer case surface. At least one inlet passage and at least one outlet passage are provided in fluid communication with the enclosed cooling passage to convey air to and from the cooling passage.

19 Claims, 5 Drawing Sheets

COOLING STRUCTURE FOR OUTER SURFACE OF A GAS TURBINE CASE

FIELD OF THE INVENTION

The present invention relates to gas turbine engines and, more particularly, to a structure for providing cooling to a case forming a section of a gas turbine engine.

BACKGROUND OF THE INVENTION

Generally, gas turbine engines have three main sections or assemblies, including a compressor assembly, a combustor assembly, and a turbine assembly. In operation, the compressor assembly compresses ambient air. The compressed air is channeled into the combustor assembly where it is mixed with a fuel and ignites, creating a heated working gas. The heated working gas is expanded through the turbine assembly. The turbine assembly generally includes a rotating assembly comprising a centrally located rotating shaft and a plurality of rows of rotating blades attached thereto. A plurality of stationary vane assemblies, each including a plurality of stationary vanes, are connected to a casing of the turbine assembly and are located interposed between the rows of rotating blades. The expansion of the working gas through the rows of rotating blades and stationary vanes in the turbine assembly results in a transfer of energy from the working gas to the rotating assembly, causing rotation of the shaft. The shaft further supports rotating compressor blades in the compressor assembly, such that a portion of the output power from rotation of the shaft is used to rotate the compressor blades to provide compressed air to the combustor assembly.

With increasing improvements in compressor efficiency and the compression ratio, the temperature of the compressed air exiting the compressor to the combustor assembly has increased. For example, in gas turbine engines being developed for use in stationary power plant applications, the compression ratio of air passing though the compressor may be on the order of 30:1, and may have discharge temperatures of approximately 550° C.

Current combustor assemblies have typically been designed to receive air at temperatures of up to approximately 450° C. An increase in the temperature of the incoming compressed air, such as up to 550° C., could cause the material of a compressor/combustor case for the combustor assembly to exceed its creep and strength limits. Hence, an increase in the case temperature could require specification of higher temperature materials, such as nickel based alloys, for the compressor/combustor case, resulting in increased costs for the production and maintenance of the combustor assembly.

SUMMARY OF THE INVENTION

In accordance with one aspect of the invention, a gas turbine case is provided comprising an outer case surface, and a channel portion formed as a recessed area extending radially inwardly into the outer case surface. An outer flow jacket is attached to the outer case surface and extends over the channel portion to define an enclosed cooling passage along the outer case surface. At least one inlet passage and at least one outlet passage are provided in fluid communication with the enclosed cooling passage. The inlet passage supplies cooling air from a source of air for effecting cooling of the case and the outlet passage conveys heated air from the case.

In accordance with another aspect of the invention, a gas turbine compressor/combustor case is provided including a plurality of circumferentially spaced combustor openings for receiving a plurality of combustors. The compressor/combustor case comprises an outer compressor/combustor case surface, and a channel portion formed as a recessed area extending radially inwardly into the outer case surface. The channel portion extends about a circumference of the compressor/combustor case and extends axially between the combustor openings. An outer flow jacket is attached to the outer case surface and extends over the channel portion to define an enclosed cooling passage along the outer case surface. At least one inlet passage and at least one outlet passage are provided in fluid communication with the enclosed cooling passage. The inlet passage supplies cooling air from a source of air for effecting cooling of the compressor/combustor case and the outlet passage conveys heated air from the compressor/combustor case.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
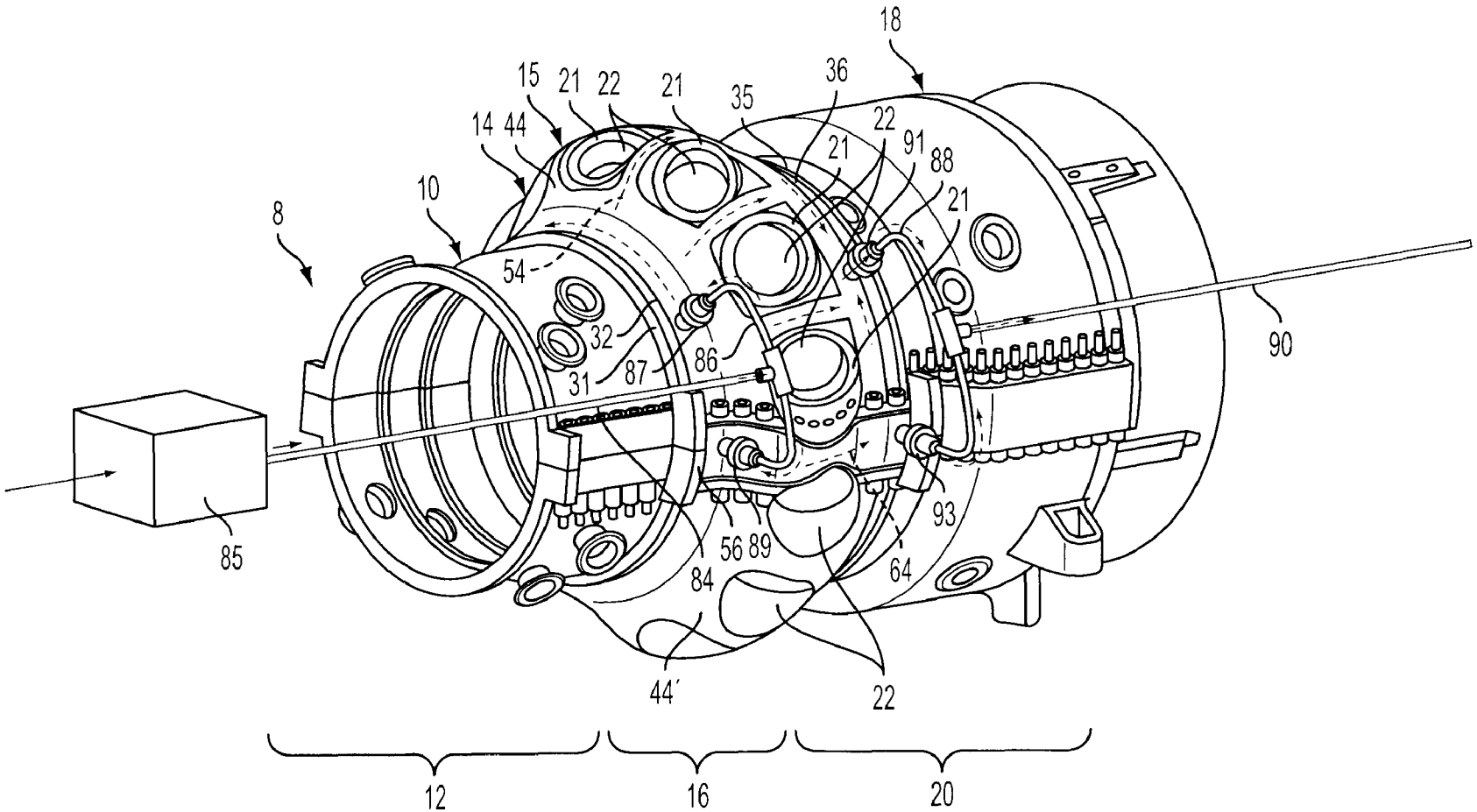
FIG. 1 is a perspective view of a turbine engine assembly including an intermediate case, a compressor/combustor case and a turbine case, and incorporating a cooling structure in accordance with the present invention.

Referring to FIG. 1, a gas turbine engine assembly 8 is shown including an intermediate case 10 defining an outer case for a downstream portion of a compressor section 12 of a turbine engine (the upstream portion of the compressor section 12 is not shown), a compressor/combustor case 14 defining an outer case for a combustor section 16 of the turbine engine and for an outlet portion of the compressor section 12, and a turbine case 18 defining an outer case for a turbine section 20 of the turbine engine. As is known in the art, the compressor section 12 supplies compressed air to the combustor section 16 where a fuel/air mixture is combusted to produce a hot working gas. The hot working gas is conveyed to the turbine section 20 where the hot working gas is expanded through a plurality of rows of rotating blades and stationary vanes (not shown) to produce rotational output on a turbine shaft (not shown).

The compressor/combustor case 14 comprises a generally cylindrical shape defining a central area 13 (FIG. 2) for receiving compressed air from the compressor section 12, and includes a first, upstream end 32 and an axially opposed second, downstream end 36. The ends 32, 36 comprise radially extending flanges configured for attachment to adjacent flanges 31, 35 of the intermediate case 10 and turbine case 18, respectively. A combustor mounting portion 15 is located generally centrally between the first and second ends 32, 36. The combustor mounting portion 15 comprises a structure extending radially outwardly from the structure of the first and second ends 32, 36 (see FIG. 6) and includes a plurality of circumferentially spaced combustor support areas 21 defining combustor openings 22 extending from an exterior to an interior of the compressor/combustor case 14. Each of the openings 22 is configured to receive a combustor (not shown). The compressor/combustor case 14 may comprise a case for any type of combustor configuration, such as an annular combustor or a can-annular combustor.

Figure 2:
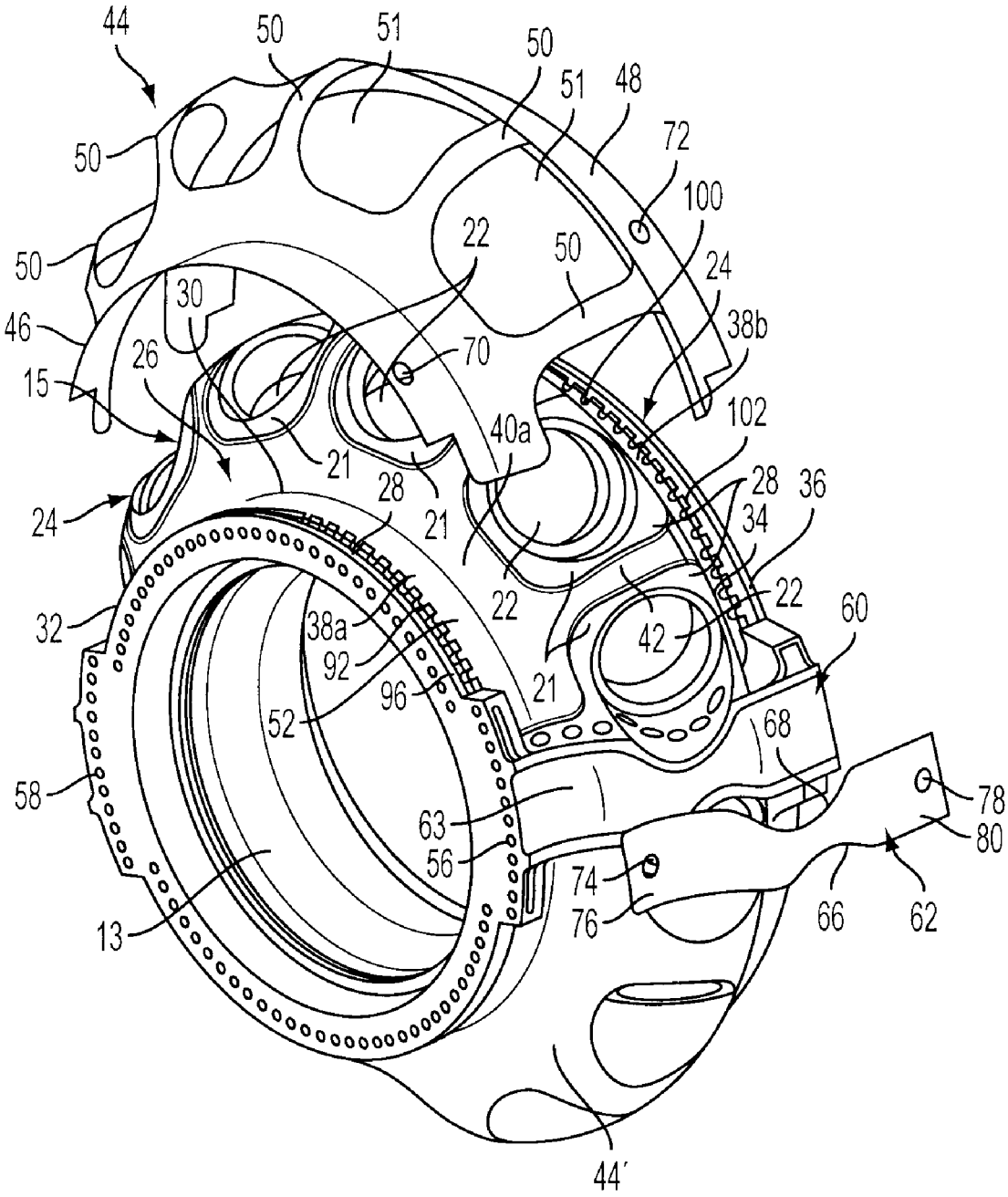
FIG. 2 is an exploded perspective view of a compressor/combustor case and showing an outer flow jacket and a channel portion formed in the case in accordance with the present invention.
Figure 3:
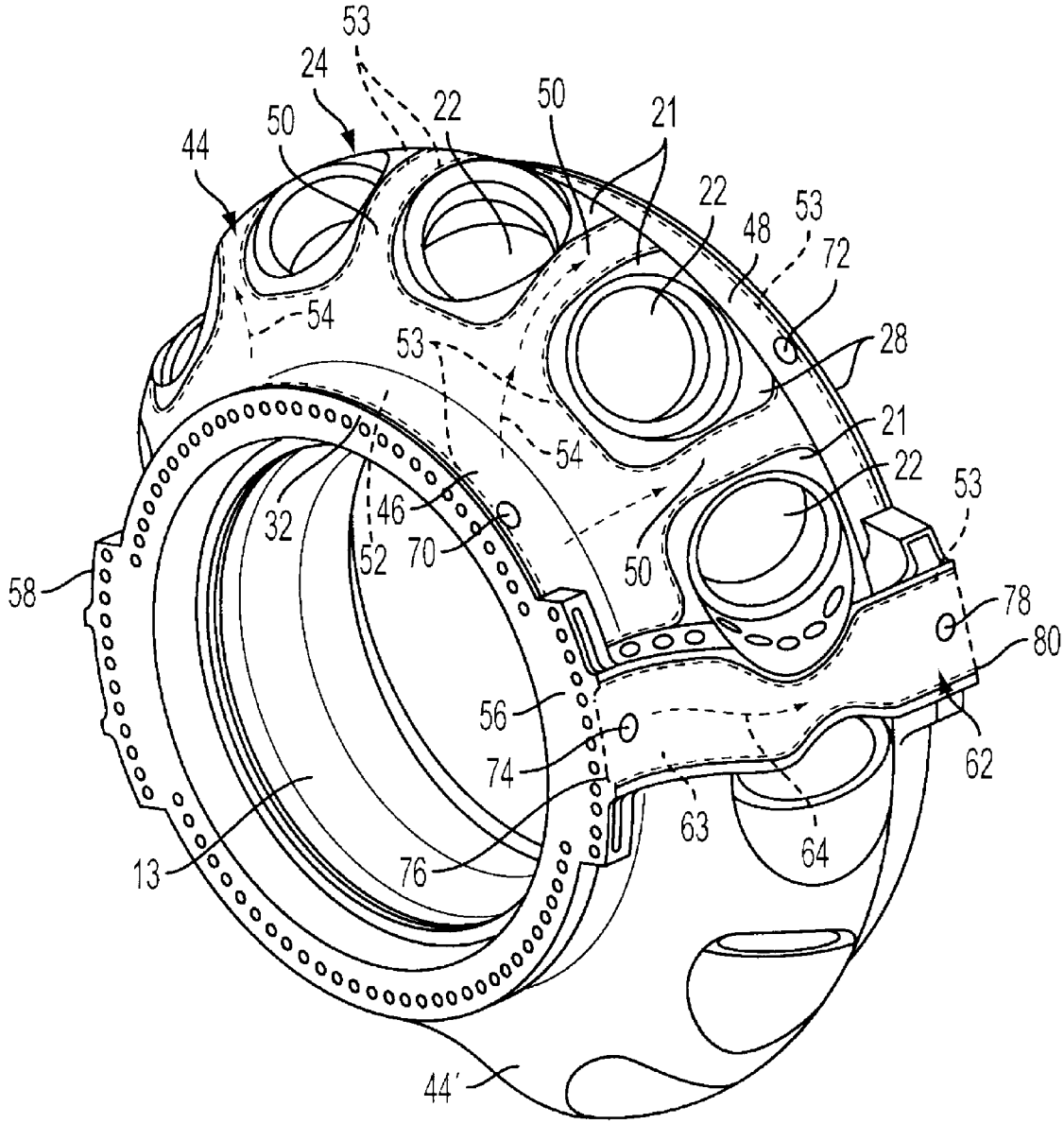
FIG. 3 is a perspective view of the compressor/combustor case and showing the outer flow jacket in position on the compressor/combustor case.

Referring further to FIGS. 2 and 3, the compressor/combustor case 14 includes an outer case surface 24 comprising an outer portion 28 and a channel portion 26 formed as an area recessed radially inwardly into the outer case surface 24. It should be understood that the compressor/combustor case 14 may comprise a configuration similar to known compressor/combustor cases but with the channel portion 26 recessed below the outer (unrecessed) portion 28 of the outer case surface 24. In particular, the outer portion 28 may be defined at the ends 32, 36 and on the combustor support areas 21. The channel portion 26 may be formed during a casting process for forming the compressor/combustor case 14, or may be formed by other means, such as by machining into the outer case surface 24 of the compressor/combustor case 14. The compressor/combustor case 14 may be formed of an alloy steel, although the present invention is not limited to a particular material and the case 14 may be formed of other materials. However, it should be understood that the present invention facilitates applications in which metals having lower strength and creep limits may be used for the compressor/combustor case, as opposed to higher temperature metals such as, for example, nickel based alloys.

Figure 6:
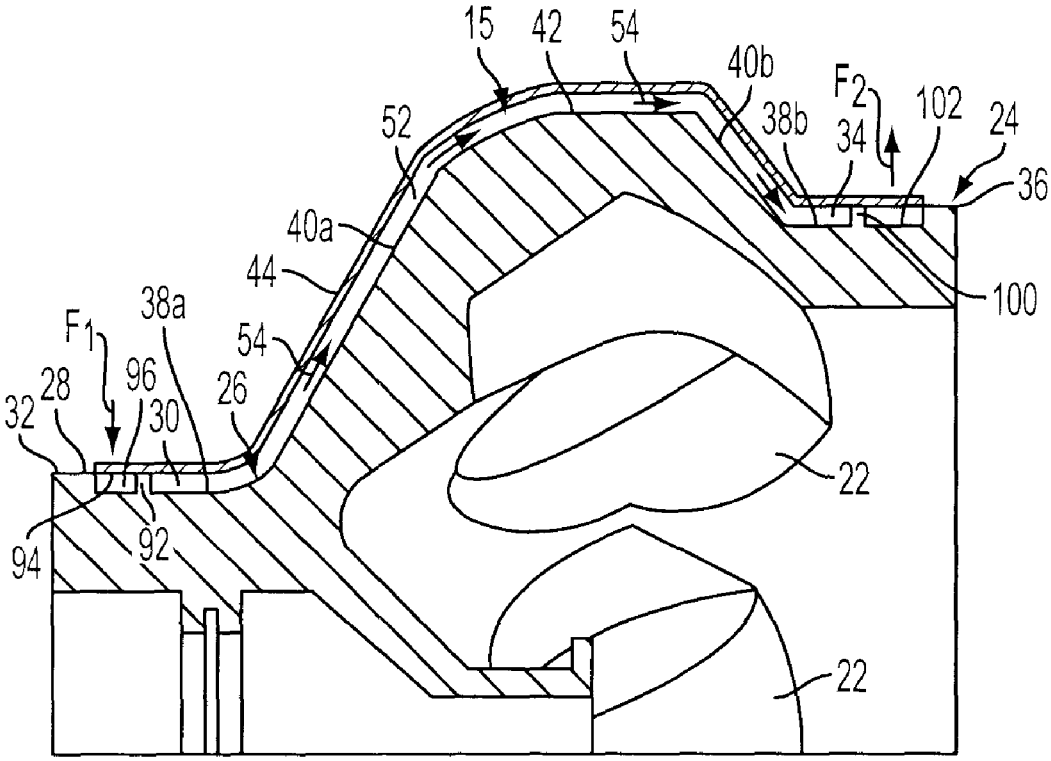
FIG. 6 is cross-sectional view through a portion of the compressor/combustor case illustrating an enclosed cooling passage defined along the outer case surface.

Referring additionally to FIG. 6, the channel portion 26 includes an upstream circumferential portion 30 adjacent the first, upstream end 32 of the compressor/combustor case 14, and a downstream circumferential portion 34 adjacent the second, downstream end 36. The upstream and downstream circumferential portions 30, 34 each include respective axial sections 38*a*, 38*b* extending generally parallel to the axis of the compressor/combustor case 14. In addition, the circumferential portions 30, 34 include respective radial sections 40*a*, 40*b* extending radially outwardly along the combustor mounting portion 15. The channel portion 26 further includes a plurality of outer portions 42 extending axially along a radially outer area of the combustor mounting portion 15 between adjacent pairs of the combustor openings 22 and defining passages between the upstream and downstream portions 30, 34 of the channel portion 26.

As seen in FIG. 2, an outer flow jacket 44 is provided for attachment to the compressor/combustor case 14, extending over the channel portion 26. The flow jacket 44 is formed with a configuration substantially matching the configuration of the outer portion 28 of the outer case surface 24 surrounding the channel portion 26 and includes an upstream circumferential end portion 46 and a downstream circumferential end portion 48. A plurality of strap members 50 extend between the end portions 46, 48 and are shaped to generally conform to the shape of the area of the combustor mounting portion 15 in the area of the axially extending outer portions 42 of the channel portion 26. The flow jacket 44 is preferably formed of a sheet metal material, such as a steel alloy sheet. However, other materials and structures may be used to provide the flow jacket 44 including, for example, a cast or machined structure configured to fit over the channel portion 26.

Referring further to FIG. 3, the flow jacket 44 is configured to be attached to the compressor/combustor case 14 by an attachment mechanism at or near the outer portion 28 of the outer case surface 24. For example, the flow jacket 44 may be attached to the compressor/combustor case 14 by welding, forming continuous seams around all edges of the flow jacket 44. Alternatively, the flow jacket 44 may be bolted to the compressor/combustor case 14, where a seal or sealing material may be positioned around the edges of the flow sleeve 44 to seal between the flow sleeve 44 and the compressor/combustor case 14. The attachment mechanism, such as the weld or bolt attachment of the flow jacket 44, is generally depicted at 53 in FIG. 3.

The flow jacket 44 fits over the channel portion 26 with the circumferential end portions 44, 46 extending over the upstream and downstream circumferential portions 30, 34, respectively, of the channel portion 26. Further, the strap members 50 of the flow jacket 44 extend over the axially extending outer portions 42 of the channel portion 26 and define openings 51 (FIG. 2) corresponding to the locations of the combustor support areas 21. The flow jacket 44 and channel portion 26 define an enclosed cooling passage 52 (FIG. 6) along the outer case surface 24 for conducting a cooling air flow, generally depicted by 54, from the upstream end 32 of the compressor/combustor case 14 to the downstream end 36, as will be described in further detail below.

The flow jacket 44 illustrated herein is configured to cover approximately half of the compressor/combustor case 14. Specifically, the flow jacket 44 extends circumferentially between split joints 56, 58 (FIG. 2) located at opposite sides of the compressor/combustor case 14. It should be understood that a similar flow jacket 44' may be provided, extending across the portion of the compressor/combustor case 14 diametrically opposite the flow jacket 44, for performing cooling on the compressor/combustor case 14 in a manner similar to that described herein with reference to the flow jacket 44.

In addition, a further channel portion 60 is defined by a recessed area of the outer case surface 24 extending axially along each of the split joints 56, 58. Split joint flow jackets 62 (only one shown in FIG. 2), each formed as an elongated strip such as a sheet metal strip, are configured to be positioned over the channel portions 60, extending between adjacent pairs of the combustor support areas 21, to define cooling passages 63 (FIG. 3) conducting cooling air flow 64 along the split joints 56, 58. As shown in FIG. 2, the flow jacket 62 may be configured with contours, such as recesses 66, 68, to fit between the adjacent combustion support areas 21.

Referring to FIGS. 2 and 3, the flow jacket 44 is formed with an inlet passage 70 defined by an aperture formed in the upstream end portion 46 of the flow jacket 44, and an outlet passage 72 defined by an aperture formed in the downstream end portion 48 of the flow jacket 44. Similarly, the split joint flow jacket 62 may be formed with an inlet passage 74 defined by an aperture at an upstream end 76 of the flow jacket 62, and an outlet passage 78 defined at a downstream end 80 of the flow jacket 62.

As seen in FIG. 1, a cooling air supply conduit 84 extends from an air supply, generally depicted by 85, to an inlet conduit 86 that is connected to each of the inlet passages 70, 74, at respective connections 87, 89, for conveying cooling air to the cooling passages 52, 63. An outlet conduit 88 is connected to each of the outlet passages 72, 78, at respective connections 91, 93, for conveying heated air from the cooling passages 52, 63 to an exhaust conduit 90 and for directing the heated air to a desired location, such as the environment or a desired location in the engine. The air supply may comprise any source of air provided at a relatively cool temperature. For example, the air source 85 may comprise a blower, such as an electrically driven blower, for directing ambient air into the cooling air supply conduit 84. Alternatively, the air source 85 may represent other sources of air, such as air that is provided from a selected area of the compressor section 12.

Figure 4:
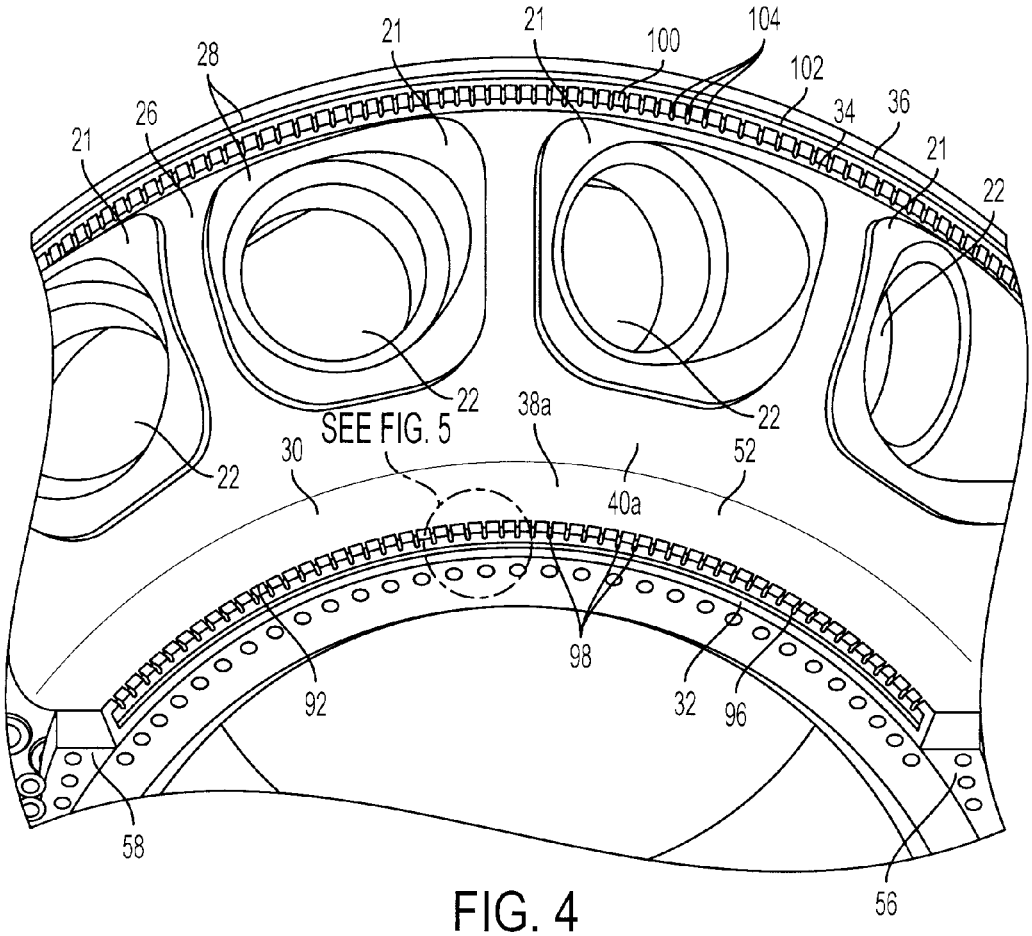
FIG. 4 is an enlarged perspective view of a portion of the compressor/combustor case illustrating the channel portion on the outer case surface.
Figure 5:
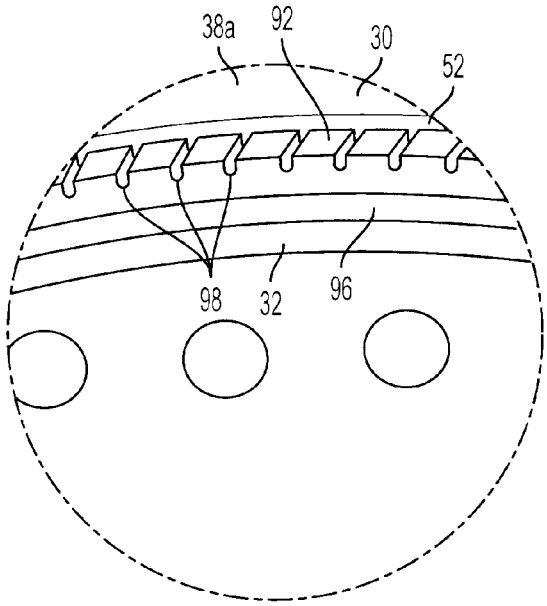
FIG. 5 is an enlarged perspective view of an area of the channel portion, as identified in FIG. 4.

Referring to FIGS. 4 and 5, an inlet plenum wall 92 is provided within the cooling passage 52 located within the axial section 38*a* of the upstream channel portion 30. The inlet plenum wall 92 is spaced downstream from the upstream end 32 and extends radially outwardly to engage the inner surface 94 (see FIG. 6) of the flow jacket 44 to define an inlet plenum 96 extending circumferentially between the split joints 56, 58. The inlet plenum wall 92 includes a plurality of inlet metering passages or slots 98 which provide fluid communication between the inlet plenum 96 and the cooling passage 52 on the opposite side of the inlet plenum wall 92. The inlet plenum 96 is in fluid communication with the inlet passage 70 to receive the cooling air flow $F_1$ (FIG. 6) supplied from the cooling air supply conduit 84, and the inlet metering slots 98 facilitate substantially uniform distribution of the cooling air, in the circumferential direction, to the cooling passage 52.

Similarly, an outlet plenum wall 100 is provided within the cooling passage 52 located within the axial section 38*b* of the downstream channel portion 34. The outlet plenum wall 100 is spaced upstream from the downstream end 36 and extends radially outwardly to engage the inner surface 94 (see FIG. 6) of the flow jacket 44 to define an outlet plenum 102 extending circumferentially between the split joints 56, 58. The outlet plenum wall 100 is of substantially the same configuration as the inlet plenum wall 92 and includes a plurality of outlet metering passages or slots 104 (FIG. 4) providing fluid communication between the cooling passage 52 and the outlet plenum 102. The outlet metering slots 104 facilitate substantially uniform reception of heated air, in a circumferential direction, from the cooling passage 52 to the outlet plenum 102. The outlet plenum 102 is in fluid communication with the outlet passage 72 to exhaust the heated air flow $F_2$ (FIG. 6) to the exhaust conduit 90.

Hence, the inlet plenum wall 92 and associated metering slots 98 and the outlet plenum wall 100 and associated metering slots 104 operate to distribute air entry and exit to and from the cooling passage 52 in a circumferential direction, to effect a substantially uniform cooling of the compressor/combustor case 14.

As an alternative to the structure described above for the inlet and outlet plenum walls 92, 100, structure (not shown) may be defined on the inner surface 94 of the flow jacket 44 extending radially inwardly and similar to the structure described for the inlet and outlet plenum walls 92, 100. Such structure may be provided with metering slots or apertures for permitting air flow between the cooling passage 52 and the inlet and outlet plenums 96, 102.

As may be apparent from the above description, cooling air provided through the supply passage 70 will pass circumferentially around the inlet plenum 96 and enter the cooling passage 52 through the inlet metering slots 98. The cooling air will transfer heat from the outer case surface 24, flowing axially across the axial section 38*a* and along the radial section 40*a*, and pass between the combustor support areas 21 through the outer portions 42 of the cooling passage 52. The cooling air will then flow along the radial section 40*b* to the axial section 38*b*, and through outlet metering slots 104 into the outlet plenum 102 where the heated air is exhausted through the outlet passage 72 into the exhaust conduit 90.

The cooling air entering the cooling passage 63 on the split joint 56 will similarly pass axially from the entry point at the upstream end 76 of the split joint cooling jacket 62 and between a pair of adjacent combustor support areas 21. The heated air will exit the cooling passage 63 through the outlet passage 78, and will be conveyed away through the exhaust conduit 90.

It should be noted that by providing cooling passages 52, 63 on the outer surface 24 of the compressor/combustor 14 it is possible to provide cooling to the compressor/combustor case 14 without substantially altering the configuration of the compressor/combustor case 14. In particular, the basic configuration of the compressor/combustor case 14 may be maintained while providing a recessed portion 26 to the outer case surface 24. Such a solution to providing cooling to the compressor/combustor case 14 is particularly desirable for applications in which increased compressor efficiencies may result in increased temperatures of air entering the compressor/combustor, i.e., through the central area 13. The present cooling structure enables design changes to an existing case to be minimized, preferably avoiding increased material requirements, such as high temperature materials for the case 14 and avoids or minimizes design changes associated with a change in the material specification for the compressor/combustor case 14.

In addition, the present cooling structure may facilitate assembly and/or maintenance in that the flow jackets 44, 63 are provided as separate parts from the compressor/combustor case 14. Hence, accessibility for assembling the flow jackets 44, 63 to the compressor/combustor assembly 14, i.e., to the outer case surface 24, provides an advantage relative to other cooling passage structures in which cooling passages are integrated into internal surfaces of a case. Locating the flow jackets 44, 63 at the outer case surface 24 of the compressor/combustor case 14 may further facilitate accessibility for maintenance operations, should such operations be necessary in the area of the cooling passages 52, 63.

Other advantages that may be obtained by the present invention include allowing usage of conventional fasteners, e.g., lower temperature steel fasteners, rather than high temperature metals, and minimizing thermal mismatch between the intermediate case 10, the compressor/combustor case 14 and turbine case 18. Further, the present invention provides a reduction in the thermal gradient through the case 14 resulting in an increase in the low cycle life of the case 14 and reduced leakage at the split joints 56, 58.

It should be understood that the degree of cooling provided to the compressor/combustor case 14 may controlled or adjusted by adjusting the radial depth or other geometry of the cooling passages 52, 63.

It should also be understood that, while the present concept for providing a cooling passage on the outer surface of compressor/combustor case has been described with reference to a particular case configuration, such description is for illustrative purposes only. The present invention may be incorporated on any case configuration to provide the advantages described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine case comprising:

an outer case surface;

a channel portion formed as a recessed area extending radially inwardly into the outer case surface and surrounded by an unrecessed portion of the outer case surface;

an outer flow jacket attached to the outer case surface and extending over the channel portion to define an enclosed cooling passage along the outer case surface, the outer flow jacket formed with a configuration that matches the configuration of the recessed area and having an outer peripheral edge forming a seal with the unrecessed portion of the outer case surface; and at least one inlet passage and at least one outlet passage in fluid communication with the enclosed cooling passage, the inlet passage supplying cooling air from a source of air for effecting cooling of the gas turbine case and the at least one outlet passage conveying heated air from the gas turbine case.

2. The gas turbine case of claim 1, wherein the channel portion extends about a circumference of the gas turbine case and the gas turbine case includes circumferentially spaced combustor openings for receiving combustors, and the enclosed cooling passage includes axially extending passages extending between adjacent ones of the combustor openings.

3. The gas turbine case of claim 2, wherein the inlet passage is located on a first axial side of the combustor openings, and the outlet passage is located on an axially opposite second side of the combustor openings.

4. The gas turbine case of claim 1, wherein the outer flow jacket comprises a sheet metal structure and the outlet passage extends radially through an opening in the outer flow jacket for conveying the heated air radially outwardly away from the gas turbine case.

5. A gas turbine compressor/combustor case including a plurality of circumferentially spaced combustor openings for receiving a plurality of combustors, the qas turbine compressor/combustor case comprising:

an outer compressor/combustor case surface;

a channel portion formed as a recessed area extending radially inwardly into the outer case surface, the channel portion extending about a circumference of the qas turbine compressor/combustor case and axially between the combustor openings;

an outer flow jacket attached to the outer case surface and extending over the channel portion to define an enclosed cooling passage along the outer case surface, the enclosed cooling passage including axially extending passages extending between adjacent ones of the combustor openings; and at least one inlet passage and at least one outlet passage in fluid communication with the enclosed cooling passage, the inlet passage supplying cooling air from a source of air for effecting cooling of the gas turbine compressor/combustor case and the outlet passage conveying heated air from the qas turbine compressor/combustor case.

6. The qas turbine compressor/combustor case of claim 5, wherein the qas turbine compressor/combustor case defines axially opposite ends for attachment to an intermediate case and a turbine case, respectively, and the inlet and outlet passages are each adjacent to one of the ends.

7. The gas turbine compressor/combustor case of claim 6, including a circumferentially extending inlet plenum connected to the inlet passage for receiving the cooling air, and a circumferentially extending outlet plenum connected to the outlet passage for exhausting the heated air.

8. The qas turbine compressor/combustor case of claim 7, including an inlet plenum wall separating the inlet plenum from the cooling passage.

9. The gas turbine compressor/combustor case of claim 8, including an outlet plenum wall separating the outlet plenum from the cooling passage.

10. The gas turbine compressor/combustor case of claim 9, including a plurality of inlet metering passages formed through the inlet plenum wall, the inlet plenum and inlet metering passages effecting a circumferential distribution of the cooling air supplied to the cooling passage.

11. The qas turbine compressor/combustor case of claim 10, including a plurality of outlet metering passages formed through the outlet plenum wall, the outlet plenum and outlet metering passages effecting a circumferential distribution of the heated air received from the cooling passage.

12. The gas turbine compressor/combustor case of claim 5, wherein the outer flow jacket comprises a circumferentially extending sheet metal member having a plurality of openings corresponding to a plurality of the combustor openings.

13. The qas turbine compressor/combustor case of claim 12, wherein the inlet and outlet passages extend radially through openings in the outer flow jacket.

14. The qas turbine compressor/combustor case of claim 12, including at least one further outer flow jacket comprising an elongated sheet metal strip extending between a pair of adjacent combustor openings.

15. The qas turbine compressor/combustor case of claim 5, wherein the outer flow jacket is attached to the outer compressor/combustor case surface by an attachment mechanism comprising at least one of welding and bolting.

16. A gas turbine case comprising:

an outer case surface;

a channel portion formed as a recessed area extending radially inwardly into the outer case surface;

an outer flow jacket attached to the outer case surface and extending over the channel portion to define an enclosed cooling passage along the outer case surface;

at least one inlet passage and at least one outlet passage in fluid communication with the enclosed cooling passage, the inlet passage supplying cooling air from a source of air for effecting cooling of the gas turbine case and the outlet passage conveying heated air from the gas turbine case; and wherein the channel portion extends about a circumference of the gas turbine case, and including an inlet plenum wall extending circumferentially around the gas turbine case and separating an inlet plenum from the cooling passage, the inlet passage providing air to the inlet plenum.

17. The qas turbine case of claim 16, including a plurality of metering passages formed through the inlet plenum wall, the inlet plenum and metering passages effecting a circumferential distribution of the cooling air supplied to the cooling passage.

18. The qas turbine case of claim 16, including an outlet plenum wall extending circumferentially around the gas turbine case and separating an outlet plenum from the cooling passage, the outlet plenum exhausting heated air to the outlet passage.

19. The gas turbine case of claim 18, including a plurality of metering passages formed through the outlet plenum wall, the outlet plenum and metering passages effecting a circumferential distribution of the heated air received from the cooling passage.

* * * * *